US005834396A

United States Patent [19]

Uemura et al.

[11] Patent Number: 5,834,396

[45] Date of Patent: Nov. 10, 1998

[54] SUBLIMATION-TYPE THERMAL IMAGE TRANSFER RECORDING MEDIUM AND THERMAL IMAGE TRANSFER RECORDING METHOD USING THE SAME

[75] Inventors: Hiroyuki Uemura; Hiroki Kuboyama, both of Mishima; Chiharu Nogawa, Numazu; Keishi Taniguchi, Susono, all of Japan

[73] Assignee: Ricoh Company, Ltd., Tokyo, Japan

[21] Appl. No.: 758,373

[22] Filed: Nov. 29, 1996

[30] Foreign Application Priority Data

Nov. 30, 1995 [JP] Japan ..... 7-335745
Nov. 22, 1996 [JP] Japan ..... 8-327849

[51] Int. Cl.[6] ..... B41M 5/035; B41M 5/38

[52] U.S. Cl. ..... 503/227; 428/195; 428/447; 428/913; 428/914

[58] Field of Search ..... 428/195, 447, 428/913, 914; 503/227

[56] References Cited

U.S. PATENT DOCUMENTS 5,348,931 9/1994 Mochizuki et al. ..... 503/227
5,376,619 12/1994 Mochizuki et al. ..... 503/227
5,525,573 6/1996 Uemura et al. ..... 503/227
5,565,404 10/1996 Mochizuki et al. ..... 503/227
5,597,774 1/1997 Uemura et al. ..... 503/227

*Primary Examiner*—Bruce H. Hess
*Attorney, Agent, or Firm*—Oblon, Spivak, McClelland, Maier & Neustadt, P.C.

[57] ABSTRACT

A sublimation thermal image transfer recording medium has a substrate, a dye-containing layer formed on the substrate, containing a sublimable dye, and a top layer formed on the dye-containing layer, with the softening temperature of the top layer being at least 200° C. which is measured in accordance with Japanese Industrial Standards JIS-K7196, and the coefficient of friction thereof being 0.2 or less which is measured in accordance with ASTM-D1894. In addition, there is provided a sublimation thermal image transfer recording method which includes the step of superimposing an image receiving sheet having a dye image receiving layer on the above-mentioned sublimation thermal image transfer recording medium, with imagewise application of heat thereto, with the dyeability of the top layer of the recording medium being controlled to be lower than that of the dye image receiving layer of the image receiving sheet.

16 Claims, No Drawings

SUBLIMATION-TYPE THERMAL IMAGE TRANSFER RECORDING MEDIUM AND THERMAL IMAGE TRANSFER RECORDING METHOD USING THE SAME

BACKGROUND OF THE INVENTION

1. Field of the Invention

The present invention relates to a sublimation-type thermal image transfer recording medium for use with copying machines and printers, and a thermal image transfer recording method using the above-mentioned recording medium.

2. Discussion of Background

Recently the demand for full color printers is increasing year by year. Representative examples of recording methods for full color printers now available include the electrophotographic method, ink-jet method, and thermal image transfer recording method. Of these methods, the thermal image transfer recording method is most widely employed because of its advantages over the other methods in that the maintenance is easy and the operation is noiseless.

The thermal image transfer recording method is carried out using a thermal image transfer recording medium, namely, an ink sheet, comprising a substrate and a dye-containing layer formed on the substrate, comprising a thermofusible material and a coloring agent dispersed therein, or a binder resin and a sublimable dye dispersed therein; and an image receiving sheet. The image receiving sheet is superimposed on the side of the dye-containing layer of the thermal image transfer recording medium, and thermal energy corresponding to the electric signals is applied to the side of the thermal image transfer recording medium using a laser beam or thermal head, whereby the coloring agent contained in the thermal image transfer medium is fused and transferred to the image receiving sheet or the sublimable dye is sublimated and moved thereto at a portion to which the thermal energy is applied.

Depending on the kind of employed recording medium, the thermal image transfer recording method can be roughly classified into two types, a thermal fusing image transfer type and a sublimation image transfer type, as previously mentioned. The sublimation image transfer type is advantageous over the thermal fusing type in that halftone can be easily obtained. Such a benefit exists because a sublimable dye is in principle sublimated and moved to the image receiving sheet in the form of independent molecules in such an amount as to correspond to the amount of thermal energy applied thereto, for instance, through a thermal head. Therefore, the sublimation image transfer type is considered to be most suitable for color printers.

However, the sublimation image transfer recording method has a shortcoming in that its running cost is high when compared with the electrophotographic method and ink-jet printing method. This is because not only coloring materials which directly contribute to the image formation, but also secondary members such as a substrate are required. In addition, according to the sublimation image transfer recording method, the thermal energy is selectively applied to the ink sheet for the formation of images, and the ink sheet is discarded after thermal recording even though large unused portions remain on the ink sheet.

To eliminate the above-mentioned shortcoming, there has been proposed a so-called n-times-speed mode. In the n-times-speed mode, the running speed of the image receiving sheet is made n (n>1) times the running speed of the ink sheet when images are printed, and the ink sheet is shifted little by little in such a manner that the first used portion and the second used portion are partially overlapped. Thus, multiple printing can be carried out, and as a matter of course, a larger value of "n" contributes to higher cost reduction.

Further, as disclosed in Japanese Laid-Open Patent Application 2-586, there is proposed a sublimation-type thermal image transfer recording medium with a two-layered structure. To be more specific, the above-mentioned sublimation-type thermal image transfer recording medium has such a structure that a dye-transfer contribution layer with a relatively small dye-releasing capability is provided on a dye-supply layer with a large dye-releasing capability. When this thermal image transfer recording medium is employed, image transfer can be efficiently carried out, and image formation can be performed without any substantial decrease of image density even by the n-times-speed mode method.

In Japanese Patent Application 2-320815, it is proposed to provide a resin layer with low dyeability on the surface of a sublimation-type thermal image transfer recording medium for preventing the formation of a ghost image and the occurrence of image blurring, which are often observed in the multiple printing operation.

The thermal image transfer recording method using a sublimable dye is based on thermal diffusion of the sublimable dye from the dye-containing layer of the recording medium to a dye image receiving layer of the image receiving sheet. When the method is compared with the conventional equal-speed mode, in which the thermal image transfer recording medium and the image receiving sheet are moved at the same speed, a heated portion of the dye-containing layer more easily adheres to the image receiving sheet with the application of heat thereto. The result is that the transportation of the thermal image transfer recording medium is hindered, thereby inducing the sticking problem. This is because when the thermal transfer recording is performed in the n-times-speed mode, the thermal image transfer recording medium, which is in contact with the image receiving sheet, is heated under the application thereto of pressure by a thermal head and a platen roller for a longer time in terms of a unit area of the recording medium, and in addition, more friction is exerted on the thermal image transfer recording medium. Further, since the sublimable dye in large quantities is contained in the dye-containing layer for the multiple printing, the bleeding of the sublimable dye easily takes place during the storage of the recording medium. As a result, the background of the image receiving sheet will be stained with the dye in the course of thermal transfer recording operation.

SUMMARY OF THE INVENTION

Accordingly, a first object of the present invention is to provide a sublimation-type thermal image transfer recording medium free from the above-mentioned conventional shortcomings, which is capable of producing normal ink images without the formation of a ghost image and the occurrence of image blurring, and in addition, without the sticking problem that the fused recording medium adheres to the image receiving sheet when the n-times-speed mode is employed.

A second object of the present invention is to provide a sublimation-type thermal image transfer recording medium with minimum bleeding of the employed sublimable dye during the storage of the recording medium.

A third object of the present invention is to provide a sublimation type thermal image transfer recording method which is capable of producing normal ink images without the formation of a ghost image and the occurrence of image blurring, and in addition, without the sticking problem that the fused recording medium adheres to the image receiving sheet when the n-times-speed mode is employed.

The first and second objects of the present invention can be achieved by a sublimation thermal image transfer recording medium comprising a substrate, a dye-containing layer formed on the substrate, comprising a sublimable dye, and a top layer formed on the dye-containing layer, having a softening temperature of at least 200° C. which is measured in accordance with Japanese Industrial Standards JIS-K7196, and a coefficient of friction of 0.2 or less which is measured in accordance with ASTM-D1894.

The third object of the present invention can be achieved by a sublimation thermal image transfer recording method for performing thermal image transfer comprising the step of superimposing an image receiving sheet on the above-mentioned sublimation thermal image transfer recording medium, with imagewise application of heat thereto, thereby performing thermal image transfer from the sublimation thermal image transfer recording medium to the image receiving sheet, the image receiving sheet comprising a dye image receiving layer which receives sublimable dye images, and the dyeability of the top layer of the sublimation thermal image transfer recording medium being lower than the dyeability of the dye image receiving layer of the image receiving sheet.

DESCRIPTION OF THE PREFERRED EMBODIMENTS

The key feature of a sublimation-type thermal image transfer recording medium of the present invention, which comprises a substrate, and a dye-containing layer and a top layer successively overlaid thereon, is that the above-mentioned top layer shows specific physical properties. To be more specific, the softening temperature of the top layer is at least 200° C. when measured in accordance with Japanese Industrial Standards JIS-K7196, and the coefficient of friction thereof is 0.2 or less when measured in accordance with ASTM-D1894. Further, to obtain such specific physical properties, it is preferable that the top layer comprise a specific compound, to be described later, as the main component.

Thus, the top layer for use in the thermal image transfer recording medium has high heat resistance and excellent lubricity, so that the thermal image transfer recording medium of the present invention can be prevented from adhering to the image receiving sheet in the course of thermal transfer recording operation to generate the sticking problem when the n-times-speed mode is employed. In addition, the dyeability of the top layer is so low that abnormal images such as a ghost image and image blurring can be prevented from occurring.

Whether the equal-speed mode or n-times-speed mode is employed, it is conventionally known that a releasing agent is added to the top layer of the thermal image transfer recording medium for the purpose of improving the releasability of the recording medium from the image receiving sheet. However, because of the difference of the process of the n-times-speed mode from that of the equal-speed mode, the required releasability of the thermal image transfer recording medium is severer when the n-times-speed mode is carried out. To be more specific, in the equal-speed mode, the thermal image transfer recording medium and the image receiving sheet are moved at the same speed. Therefore, even if a portion of the dye-containing layer of the thermal image transfer recording medium is softened and attached to a dye image receiving layer of the image receiving sheet by the application of heat thereto, the thermal image transfer recording medium may be peeled from the image receiving sheet after the thermal head has passed the above-mentioned portion. In contrast to this, it is necessary that the thermal image transfer recording medium be peeled from the image receiving sheet simultaneously with the completion of thermal printing by the thermal head in the n-times-speed mode because the thermal image transfer recording medium and the image receiving sheet are moved at different speeds. Namely, if the transporting speed of the thermal image transfer recording medium is delayed for a moment due to the sticking to the image receiving sheet, this will cause the formation of abnormal images.

Further, the surface temperature of the thermal image transfer recording medium is controlled according to the image pattern to be obtained by changing the thermal energy applied to the recording medium. Therefore, when the frictional resistance of the surface of the recording medium is largely temperature-dependent, the transporting speed of the recording medium cannot be kept constantly. This will also induce the formation of abnormal images.

With the above points taken into consideration, in the n-times-speed mode, the sublimation-type thermal image transfer recording medium is required to have the following properties: (1) excellent releasability from the image receiving sheet under the application of heat; (2) low frictional resistance independent of temperature; and (3) low adhesion to the image receiving sheet under the application of heat. Those properties are required for the sublimation thermal image transfer recording medium only in the n-times-speed mode. On the contrary, in the equal-speed mode, low frictional resistance of the thermal image transfer recording medium is anything but unnecessary, it is an unfavorable property because the recording medium will easily become creased.

In the present invention, it is preferable that the top layer of the thermal image transfer recording medium comprise a block copolymer which comprises a polydimethyl siloxane moiety and a vinyl polymer moiety including a hydrolyzable silyl group and is cured. When the top layer comprises the above-mentioned specific compound, it is found that bleeding of a sublimable dye for use in the dye-containing layer can be prevented during the storage, and ink images with high image density can be produced. Further, the sticking of the thermal image transfer recording medium to the image receiving sheet can be prevented, and images can be uniformly obtained on the image receiving sheet owing to high lubricity of the top layer.

In addition to the above, it is preferable that the dyeability of the top layer of the sublimation-type thermal image transfer recording medium be lower than that of the dye image receiving layer of the image receiving sheet. By controlling the dyeabilities so as to satisfy the above-mentioned relationship, it is possible to prevent the occurrence of abnormal images such as a ghost image and image blurring, which result from the reverse transfer of the ink image to the thermal image transfer recording medium after the ink image has been transferred to the image receiving sheet. The dyeabilities of the top layer of the thermal image transfer recording medium and the dye image receiving layer of the image receiving sheet can be compared in such a manner that the top layer and the dye image receiving layer are independently provided on a substrate, and ink images are transferred to each layer under the same conditions. The image density of the ink images formed on each layer may be measured using an instrument for measuring the optical density such as a Mcbeth densitometer.

Further, in the thermal image transfer recording medium according to the present invention, it is preferable that the top layer be provided on the dye-containing layer by a coating method using a solvent in which the solubility of a dye employed in the dye-containing layer is low, for example, an aqueous solvent or an alcohol-based solvent. If the solubility of the dye in the employed solvent is high, the dye contained in the dye-containing layer is dissolved in the course of the coating operation for the formation of the top layer on the dye-containing layer, and then, migrates to the top layer. In this case, the dye tends to bleed to the surface of the thermal image transfer recording medium with the lapse of time.

As previously mentioned, it is preferable that the top layer of the thermal image transfer recording medium comprise a block copolymer (A) comprising a polydimethyl siloxane moiety ($a^1$) and a vinyl polymer moiety ($a^2$) including a hydrolyzable silyl group. The structure of the block polymer (A) can be expressed in the following three ways:

(1) $(a^1*a^2)_l$, (2) $a^1*(a^2*a^1)_m$, and (3) $a^2*(a^1*a^2)_n$, in which l, m and n are each an integer of 1 to 10.

The polydimethyl siloxane moiety ($a^1$) and the vinyl polymer moiety ($a^2$) including a hydrolyzable silyl group are as follows:

($a^1$):

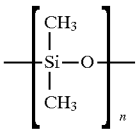

($a^2$):

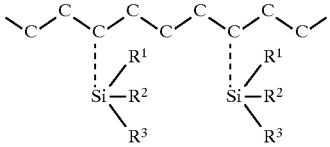

wherein $R^1$, $R^2$ and $R^3$ are each independently an alkoxyl group having 1 to 4 carbon atoms or an aliphatic hydrocarbon group having 1 to 8 carbon atoms, except the case where all of $R^1$, $R^2$ and $R^3$ are aliphatic hydrocarbon groups having 1 to 8 carbon atoms at the same time.

The above-mentioned block copolymer (A) can be synthesized by (1) living polymerization, (2) polymerization using a polymeric initiator, or (3) polymeric chain transfer reaction. The methods (2) and (3) are advantageous from the industrial viewpoint.

When the polymerization is carried out using a polymeric initiator according to the method (2), for instance, a polymeric azo initiator into which a polydimethyl siloxane moiety ($a^1$) is introduced, as shown below, may be employed:

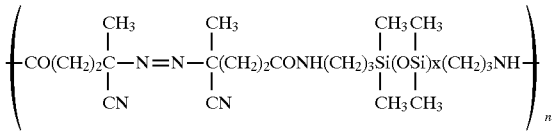

wherein x is an integer of 10 to 300; and n is an integer of 1 to 50.

To the above-mentioned polymeric azo initiator, a vinyl monomer including a hydrolyzable silyl group is added, optionally in combination with other copolymerizable vinyl monomers. Thus, a block copolymer (A) can be produced efficiently.

When a polymeric initiator, such as a polymeric peroxide initiator or a polymeric azo initiator is employed, the block copolymer (A) can be polymerized by two steps. For instance, the reaction scheme of the polymerization using an azo-type polymeric initiator is as follows:

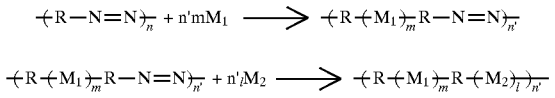

wherein;

m, n, n' and l: an integer of 1 or more;

$M_1$: a silicon monomer or macro monomer represented by the following formulae;

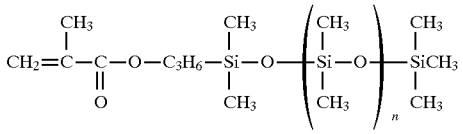

in which n is an integer of 0 to 64.

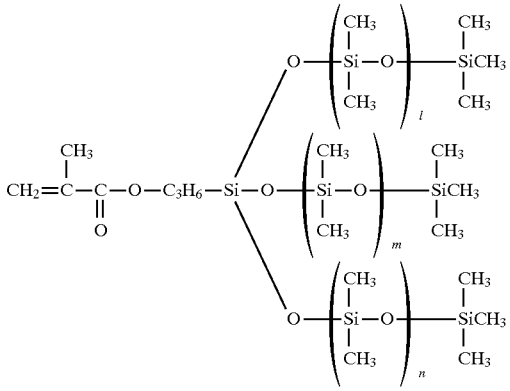

in which l+m+n≦64;

$M_2$: a copolymerizable vinyl monomer including a vinyl monomer having a hydrolyzable silyl group;

R: for example,

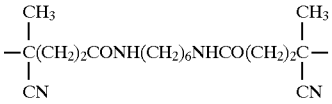

-continued

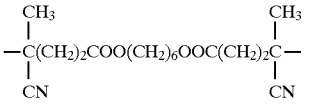

When the block polymer (A) is obtained by the above-mentioned chain transfer reaction method (3), HS-$CH_2$COOH or HS-$CH_2CH_2$COOH is added to a polydimethyl siloxane with a functional group represented by the following formulae:

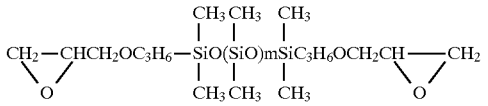

wherein m is an integer of 10 to 400.

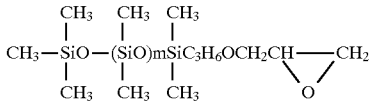

wherein m is an integer of 10 to 400.

Then, with the addition of a vinyl monomer having a hydrolyzable silyl group and other copolymerizable vinyl monomers to the above-mentioned polydimethyl siloxane, the polymerization is carried out in accordance with the chain transfer reaction of SH group of the polydimethyl siloxane, thereby obtaining a block copolymer (A).

In this case, it is preferable that the polydimethyl siloxane moiety in the block copolymer (A) comprise at least two polydimethyl siloxane moieties having silicone chains with different weight average molecular weights in order to further improve the sticking preventing effect. In particular, it is effective to employ two or more polydimethyl siloxane moieties having silicone chains with different weight average molecular weights within the range of 1,000 to 30,000.

Thus, the sticking preventing effect can be imparted to the thermal image transfer recording medium of the present invention without employing other lubricants, releasing agents and surfactants, so that it is possible to eliminate the side effects caused by those agents, in particular, hindrance to the formation of uniform images.

Specific examples of the vinyl monomer having a hydrolyzable silyl group for use in the block copolymer (A) include silane coupling agents such as γ-methacryloxypropyl trimethoxysilane, γ-methacryloxypropyl triethoxysilane, γ-methacryloxypropyl methyldimethoxysilane, γ-methacryloxypropyl methylethoxysilane, γ-methacryloxypropyl methoxyethoxysilane, vinyltrimethoxysilane, and vinyltriethoxysilane.

Examples of the above-mentioned copolymerizable vinyl monomers used in the polymerization methods (2) and (3) are as follows: aliphatic and cyclic acrylate and/or methacrylate such as methyl acrylate, ethyl acrylate, n-propyl acrylate, iso-propyl acrylate, n-butyl acrylate, iso-butyl acrylate, t-butyl acrylate, 2-ethylhexyl acrylate, cyclohexyl acrylate, tetrahydrofurfuryl acrylate, stearyl acrylate, lauryl acrylate, methyl methacrylate, ethyl methacrylate, n-propyl methacrylate, iso-propyl methacrylate, n-butyl methacrylate, iso-butyl methacrylate, 2-ethylhexyl methacrylate, cyclohexyl methacrylate, tetrahydrofurfuryl methacrylate, stearyl methacrylate, and lauryl methacrylate; vinyl ethers such as methyl vinyl ether, ethyl vinyl ether, n-propyl vinyl ether, n-butyl vinyl ether, and iso-butyl vinyl ether; styrenes such as styrene and a-methylstyrene; nitrile monomers such as acrylonitrile and methacrylonitrile; fatty-acid-containing monomers, such as vinyl acetate and vinyl propionate; halogen-containing monomers such as vinyl chloride, vinylidene chloride, vinyl fluoride, and vinylidene fluoride; olefins such as ethylene, propylene, and isoprene; dienes such as chloroprene and butadiene; α,β-unsaturated carboxylic acids such as acrylic acid, methacrylic acid, itaconic acid, maleic acid, maleic anhydride, crotonic acid, atropic acid, and citraconic acid; amides such as acrylamide, methacrylamide, N,N-methylolacrylamide, N,N-dimethylacrylamide, diacetone acrylamide, and methylacrylamide glycolate methyl ether; amino-group-containing monomers such as N,N-dimethylaminoethyl methacrylate, N,N-diethylaminoethyl methacrylate, N,N-dimethylaminopropyl methacrylate, N,N-dimethylaminoethyl acrylate, N,N-diethylaminoethyl acrylate, and N,N-dimethylaminopropyl acrylate; epoxy-group-containing monomers such as glycidyl acrylate, glycidyl methacrylate, and glycidyl allyl ether; reaction products of a group A including 2-hydroxyethyl methacrylate, 2-hydroxyethyl acrylate, 2-hydroxypropyl methacrylate, 2-hydroxypropyl acrylate, 4-hydroxybutyl acrylate and allyl alcohol, with a group B including acrylic acid, methacrylic acid, itaconic acid, maleic acid and crotonic acid; and other monomers such as vinylpyrrolidone, vinylpyridine, and vinylcarbazole.

Those vinyl monomers may be used alone or in combination.

In the above-mentioned polymerization methods (2) and (3), the polymerization is generally carried out in a solution. For the solution polymerization, there can be employed aromatic hydrocarbon solvents such as toluene, and xylene; ketone-based solvents such as acetone, methyl ethyl ketone, and methyl isobutyl ketone; ester-based solvents such as ethyl acetate, propyl acetate, isobutyl acetate, and butyl acetate; alcohol-based solvents such as methanol, ethanol, isopropanol, butanol, and isobutanol. Those solvents can be used alone or in combination.

Further, in the above-mentioned polymerization, polymerization initiators such as benzoyl peroxide, lauroyl peroxide, cumene hydroperoxide, dicumyl peroxide, t-butyl peroxyisopropyl carbonate, t-butyl perbenzoate, di-t-butyl peroxide, azobisisobutyronitrile, and azobisvaleronitrile may also be used, but not always be used in the polymerization method (2).

With respect to the total weight of the thus obtained block copolymer (A), it is preferable that the amount ratio of the siloxane moiety be in the range of 1 to 60 wt. %, more preferably 5 to 40 wt. %; the amount ratio of the moiety of a vinyl monomer having a hydrolyzable silyl group be in the range of 1 to 30 wt. %; and the amount ratio of other copolymerizable vinyl monomers be in the range of 5 to 85 wt. %. It is desirable that the above-mentioned copolymerizable vinyl monomers comprise a vinyl monomer having hydroxyl group or epoxy group.

The polydimethyl siloxane containing block copolymer (A) thus obtained has good compatibility with other synthetic resins, so that it can effectively work as a compatibilizing agent. Therefore, the block copolymer (A) can be used in combination with a synthetic resin, for example, silicone resin, polyvinyl acetoacetal or polyvinyl butyral.

When the above-mentioned block copolymer (A) is cured, a cross-linking agent (B), that is, a silane compound having a hydrolyzable group may be used. The cross-linking agent (B) for use in the present invention is selected from the group consisting of an alkoxysilane, a chlorosilane, and a silane coupling agent. In the case where the above-mentioned silane coupling agent is polymerizable, a polymer of the silane coupling agent may be employed. In addition, there can also be used a hydrolysis product obtained by the hydrolysis of a hydrolyzable group contained in the above-mentioned monomer or polymer of the silane coupling agent.

Specific examples of the alkoxysilane serving as the cross-linking agent (B) are tetraalkoxysilane such as tetramethoxysilane, tetraethoxysilane, tetrabutoxysilane, and trimethoxyneopentoxysilane; alkyl trialkoxysilane such as methyl trimethoxysilane, methyl triethoxysilane, and phenyl trimethoxysilane; dialkyl dialkoxysilane such as dimethyl dimethoxysilane, methylphenyl dimethoxysilane, and diphenyl dimethoxysilane; and colloidal silica.

Examples of the chlorosilane serving as the cross-linking agent (B) are trimethylchlorosilane, dimethyldichlorosilane, dimethylchlorosilane, methyltrichlorosilane, methyldichlorosilane, triphenylchlorosilane, and phenylchlorosilane.

Specific examples of the silane coupling agent serving as the cross-linking agent (B) are aminoalkyl alkoxysilane such as aminomethyl triethoxysilane, N-β-aminoethylaminomethyl trimethoxysilane, N-β-aminoethyl trimethoxysilane, N-β-(aminoethyl)-γ-aminopropyl trimethoxysilane, γ-aminopropyl trimethoxysilane and γ-aminopropyl triethoxysilane; epoxyalkyl alkoxysilane such as γ-glycidoxypropyl trimethoxysilane, γ-glycidoxypropyl-methyl dimethoxysilane, β-(3,4-epoxycyclohexyl)ethyl trimethoxysilane, and β-(3,4-epoxycyclohexyl)ethylmethyl dimethoxysilane; mercaptoalkyl alkoxysilane such as γ-mercaptopropyl trimethoxysilane and γ-mercaptopropyl-methyl dimethoxysilane; halogenated alkyl alkoxysilane such as γ-chloropropyl trimethoxysilane and 3,3,3-trichloropropyl trimethoxysilane; and hydroxysilane compounds such as alkyltriacyloxysilane, alkenyltriacyloxysilane, aryltrialkoxysilane and trimethoxysilane. Further, as the polymerizable silane coupling agent, the previously mentioned vinyl monomer having a hydrolyzable silyl group for use in the block copolymer (A) can be used. A polymer of such a silane coupling agent can also be used as the cross-linking agent (B). Further, there can be employed a monomer or polymer of the silane compound having unsaturated bond, previously mentioned in the examples of the vinyl monomer having a hydrolyzable silyl group.

The above-mentioned cross-linking agent (B) may be used alone or in combination when the block copolymer (A) is cured. The cross-linking agent (B), that is, a silane compound having a hydrolyzable group, may be used as it is. Alternatively, the silane compound which has been subjected to hydrolysis or partial condensation may be used as the cross-linking agent. To be more specific, a hydrolysis product of the silane compound is obtained by adding water to a silane compound having a hydrolyzable group in an alcohol-based solvent in the presence of an acid or alkaline catalyst. In this case, there can be obtained an alcohol-soluble silica gel, silica sol, or siloxane composition in a completely hydrolyzed state when the calculated amount of water equivalent or more to the silane compound having a hydrolyzable group is added. In contrast to this, when the amount of water is less than the equivalent amount, the silane compound is partially hydrolyzed according to the amount ratio of water.

Further, the block copolymer (A) for use in the top layer of the thermal image transfer recording medium may be cured using a catalyst (C). The film performance of the block copolymer (A) is further improved when the block copolymer (A) is cured using at least one catalyst selected from the group consisting of an aluminum chelating agent, an organic tin compound, an organic titanate compound, an organic acid, and an inorganic acid.

When the above-mentioned catalyst is employed, the block copolymer (A) is cured in accordance with the following reaction schemes:

1) $—Si(OR)_n \rightarrow —Si(OH)_n$

2) $—Si(OH)_n + —Si(OR)_n \rightarrow —SiOSi— + nROH$

3) $—Si(OR)_n + —Si(OR)_n \rightarrow —SiOSi— + nH_2O$

In the case where the polydimethyl siloxane containing block copolymer (A) comprises hydroxyl group, the following reaction is carried out:

4) $—OH + —Si(OR)_n \rightarrow —Si(OR)_{n-1}—$

It is possible to analyze the cured product by conventional composition analysis, elemental analysis or surface analysis.

When the block copolymer (A) comprising a polydimethyl siloxane moiety and a vinyl polymer moiety including a hydrolyzable silyl group is cured using the above-mentioned cross-linking agent (B), it is preferable that the amount ratio by weight of a solid content of the block copolymer (A) to that of the cross-linking agent (B) be in the range of 100:0 to 1:99, more preferably in the range of 70:30 to 50:50. When the amount ratio of the block copolymer (A) to the cross-linking agent (B) is within the above-mentioned range, various performance is effectively improved.

When the catalyst (C) is employed, it is preferable that the amount ratio by weight of (A)+(B):(C) be in the range of 100:0.1 to 100:10 in terms of the solid content.

Preparation Example 1

[Preparation of Cross-linking Agent (B)]

80 parts by weight of ethanol were placed into a 500-ml flask equipped with a stirrer, a thermometer, a condenser and a nitrogen-gas introducing tube. 180 parts by weight of methyl trimethoxysilane and 20 parts by weight of γ-glycidoxypropyl trimethoxysilane were added to ethanol and dissolved therein with stirring.

Then, a solution prepared by dissolving 5 parts by weight of 60% hydrochloric acid in 40 parts by weight of demineralized water was added dropwise to the above prepared solution, and the reaction was carried out with stirring at a reaction temperature of 80° C. for 5 hours. Thus, a hydrolyzed silane compound, namely, a cross-linking agent (B) for use in the present invention was obtained.

Preparation Example 2

[Preparation of Block Copolymer (A-1)]

The following components were placed into a 500-ml flask equipped with a stirrer, a thermometer, a condenser and a nitrogen-gas introducing tube:

| | Parts by Weight |
|---|---|
| Isopropyl alcohol | 200 |
| Methyl methacrylate | 35 |
| n-butyl methacrylate | 15 |
| 2-hydroxyethyl methacrylate | 20 |
| γ-methacryloxypropyl trimethoxysilane | 10 |
| Polydimethyl siloxane based azo polymerization initiator with a silicone chain having a weight average molecular weight of 5000, "VPS-0501" (Trademark), made by Wako Pure Chemical Industries, Ltd. | 20 |

The above-mentioned components were stirred until they were uniformly mixed. Then, the mixture was heated to 80° C., and the polymerization reaction was carried out for 5 hours. Thus, a resin solution (A-1) with a solid content of 33.3 wt. % was obtained.

Preparation Example 3

[Preparation of Block Copolymer (A-2)]

The procedure for preparation of the resin solution (A-1) as employed in Preparation Example 2 was repeated except that the commercially available polydimethyl siloxane based azo polymerization initiator with a silicone chain having a weight average molecular weight of 5,000, "VPS-0501" (Trademark), made by Wako Pure Chemical Industries, Ltd. was replaced by a polydimethyl siloxane based azo polymerization initiator with a silicone chain having a weight average molecular weight of 10,000, "VPS-1001" (Trademark), made by Wako Pure Chemical Industries, Ltd.

Thus, a resin solution (A-2) with a solid content of 33.3 wt. % was obtained.

Preparation Example 4

[Preparation of Block Copolymer (A-3)]

The following components were placed into a 500-ml flask equipped with a stirrer, a thermometer, a condenser and a nitrogen-gas introducing tube:

| | Parts by Weight |
|---|---|
| Isopropyl alcohol | 200 |
| Methyl methacrylate | 20 |
| n-butyl methacrylate | 10 |
| 3-methacryloxypropyl tris (trimethylsiloxy) silane | 20 |
| 2-hydroxyethyl methacrylate | 20 |
| γ-methacryloxypropyl trimethoxysilane | 10 |
| Polydimethyl siloxane based azo polymerization initiator with a silicone chain having a weight average molecular weight of 5,000, "VPS-0501" (Trademark), made by Wako Pure Chemical Industries, Ltd. | 20 |

The above-mentioned components were stirred until they were uniformly mixed. Then, the mixture was heated to 80° C., and the polymerization reaction was carried out for 5 hours. Thus, a resin solution (A-3) with a solid content of 33.3 wt. % was obtained.

Preparation Example 5

[Preparation of Block Copolymer (A-4)]

The following components were placed into a 500-ml flask equipped with a stirrer, a thermometer, a condenser and a nitrogen-gas introducing tube:

| | Parts by Weight |
|---|---|
| Isopropyl alcohol | 200 |
| Methyl methacrylate | 35 |
| n-butyl methacrylate | 15 |
| 2-hydroxyethyl methacrylate | 20 |
| γ-methacryloxypropyl trimethoxysilane | 10 |
| Polydimethyl siloxane having thiol radical at both ends, "X22-167B" (Trademark), made by Shin-Etsu Chemical Co., Ltd. | 20 |
| Azobisisobutyronitrile | 1 |

The above-mentioned components were stirred until they were uniformly mixed. Then, the mixture was heated to 80° C., and the polymerization reaction was carried out for 5 hours. Thus, a resin solution (A-4) with a solid content of 33.3 wt. % was obtained.

Preparation Example 6

[Preparation of Block Copolymer (A-5)]

The procedure for preparation of the resin solution (A-1) as employed in Preparation Example 2 was repeated except that 20 parts by weight of the commercially available polydimethyl siloxane based azo polymerization initiator with a silicone chain having a weight average molecular weight of 5,000, "VPS-0501" (Trademark), made by Wako Pure Chemical Industries, Ltd. were reduced to 5 parts by weight, and 15 parts by weight of a polydimethyl siloxane based azo polymerization initiator with a silicone chain having a weight average molecular weight of 10,000, "VPS-1001" (Trademark), made by Wako Pure Chemical Industries, Ltd. were added thereto.

Thus, a resin solution (A-5) with a solid content of 33.3 wt. % was obtained.

In the present invention, it is also preferable that the top layer of the thermal image transfer recording medium comprise a silicone graft polymer. In this case, there can be employed a variety of silicone graft polymers prepared by grafting a silicone on a resin such as polyvinyl butyral resin, epoxy resin, polyester resin, polyurethane resin, acrylic resin, melamine resin or vinyl chloride resin. For example, there are commercially available silicone graft polymers "DAIALLOMER SP3023™," "DAIALLOMER SP2105™," "DAIALLOMER SP711™," and "DAIALLOMER SP712™." Those are trademarks of DainichiSeika Color and Chemicals Mfg. Co., Ltd.

When the above-mentioned silicone graft polymer is cured using an isocyanate compound, the softening point of the obtained silicone graft polymer can be increased. As a result, the top layer for use in the thermal image transfer recording medium can be prevented from fusing and adhering to the image receiving sheet while ink images are transferred to the image receiving sheet by the n-times-speed mode. Further, in order to improve the lubricity of the top layer, it is preferable that the ratio by weight of the silicone moiety to the resin moiety be 10% or more in the obtained silicone graft polymer.

Specific examples of the isocyanate used for curing the silicone graft polymer are tolylene diisocyanate, 4,4-diphenylmethane diisocyanate, xylene diisocyanate, tetramethyl xylene diisocyanate, m-isopropenyl-α,α-dimethylbenzyl isocyanate, an additional product of each of the above-mentioned isocyanate compounds with trimethylolpropane, and a trimer of the isocyanate compound.

Of these isocyanate compounds, ones with slow reactivity, such as alicyclic or aliphatic isocyanate compounds including 1,3-bis(isocyanatomethyl)cyclohexane, hexamethylene diisocyanate, an additional product of such an isocyanate compound with trimethylolpropane, and a trimer of such an isocyanate compound are preferably employed to extend the pot life of a coating liquid for the top layer.

When the silicone graft polymer is employed for the top layer of the thermal image transfer recording medium, the top layer may be provided on the dye-containing layer by a coating method using an alcohol solvent. To minimize the bleeding of a dye for use in the dye-containing layer to the surface of the thermal image transfer recording medium, any alcohol-based solvent is useful for the preparation of a coating liquid of the top layer so long as the dye employed in the dye-containing layer is not soluble in that alcohol solvent. Further, to inhibit the reaction of the alcohol solvent with the above-mentioned isocyanate compound, secondary alcohols such as isopropyl alcohol, sec-butanol, 2-pentanol, 3-methyl-2-butanol, 2-heptanol, 3-heptanol, and 2-octanol are preferable, and tertiary alcohols such as 2-methyl-2-butanol and 2-methyl-2-hexanol are more preferable.

An isocyanate compound having a hydrophilic group therein can be dissolved in the alcohol solvent satisfactorily. Therefore, by using such an isocyanate compound having a hydrophilic group, for example, a commercially available isocyanate compound "STAPHYLOID THD703" (Trademark), made by Takeda Chemical Industries, Ltd., a silicone graft polymer can be stably cured.

In the top layer of the thermal image transfer recording medium, it is preferable that the mixing ratio of the isocyanate compound to the resin having hydroxyl group be in the range of 0.1 to 2.0, more preferably in the range of 0.5 to 1.5, in terms of the molar ratio of NCO/OH.

In addition, according to the present invention, it is preferable that the top layer further comprise a silicone oil in an effective amount for reducing the coefficient of friction of the top layer.

Specific examples of the silicone oil for use in the present invention are dimethyl silicone oil, methylphenyl silicone oil, fluorine-modified silicone oil, amino-modified silicone oil, alcohol-modified silicone oil, epoxy-modified silicone oil, carboxy-modified silicone oil, phenyl-modified silicone oil, polyether-modified silicone oil, alkyl-modified silicone oil, and mercapto-modified silicone oil.

Those silicone oils may be used alone or in combination.

Of those silicone oils, epoxy-modified, amino-modified and alcohol-modified silicone oils are preferable, so that at least one selected from those modified silicone oils may be contained in the top layer. It is further preferable that a mixture of dimethyl silicone oil and at least one of the above-mentioned modified silicone oils, such as epoxy-modified, amino-modified and alcohol-modified silicone oils be contained in the top layer. It is preferable that the amount of the silicone oil be in the range of 0.1 to 20 wt. %, more preferably in the range of 1 to 10 wt. % of the total weight of the top layer.

It is preferable that the thickness of the top layer be in the range of 0.1 to 2.0 $\mu$m, more preferably 0.5 to 1.0 $\mu$m.

The dye-containing layer for use in the sublimation thermal image transfer recording medium of the present invention will now be explained in detail.

Any dye-containing layer conventionally known in the field of a thermal image transfer recording medium is usable in the present invention. There can be employed a single-layered dye-containing layer comprising a sublimable dye and a binder agent, or a laminated dye-containing layer comprising a dye-supply layer and a dye-transfer-contribution layer which are successively overlaid on the substrate.

Any dyes which can sublime or vaporize at a temperature of 60° C. or more, preferably disperse and oil-soluble dyes, which are ordinarily used in the field of thermal image transfer recording, can be used in the dye-containing layer of the sublimation-type thermal image transfer recording medium of the present invention.

Specific examples of the sublimable dyes include C. I. Disperse Yellows 1, 3, 8, 9, 16, 41, 54, 60, 77 and 116; C. I. Disperse Reds 1, 4, 6, 11, 15, 17, 55, 59, 60, 73 and 83; C. I. Disperse Blues 3, 14, 19, 26, 56, 60, 64, 72, 99 and 108; C. I. Solvent Reds 23, 25 and 27; and C. I. Solvent Blues 36, 83 and 105. These dyes can be used alone or in combination.

As the binder agent for use in the dye-containing layer, a thermoplastic or thermosetting resin can be employed.

Specific examples of the thermoplastic and thermosetting resins for use in the dye-containing layer include vinyl chloride resin, vinyl acetate resin, polyamide, polyethylene, polycarbonate, polystyrene, polypropylene, acrylic resin, phenolic resin, polyester, polyurethane, epoxy resin, silicone resin, fluorine-containing resin, butyral resin, melamine resin, polyvinyl alcohol, and cellulose resin. These resins can be used alone or in combination. In addition, a variety of copolymers prepared from the monomers used in the above resins can be employed.

It is preferable that the thickness of the dye-containing layer be in the range of 0.5 to 10 $\mu$m, more preferably in the range of 3 to 7 $\mu$m.

As the materials for the substrate of the sublimation type thermal image transfer recording medium according to the present invention, condenser paper, polyester film, polystyrene film, polysulfone film, polyimide film, and polyaramide film are available.

When necessary, a conventional adhesive layer (intermediate adhesive layer) may be interposed between the substrate and the dye-containing layer, and a conventional heat-resistant lubricating layer may be provided on the back side of the substrate, opposite to the dye-containing layer with respect to the substrate.

According to the sublimation thermal image transfer recording method of the present invention, an image receiving sheet is superimposed on the above-mentioned sublimation thermal image transfer recording medium, with image-wise application of heat thereto, thereby performing thermal image transfer from the sublimation thermal image transfer recording medium to the image receiving sheet, the image receiving sheet comprising a dye image receiving layer which receives sublimable dye images. As previously mentioned, the sublimation thermal image transfer recording medium for use in the thermal image transfer recording method comprises the above-mentioned top layer having a softening temperature of at least 200° C. which is measured in accordance with Japanese Industrial Standards JIS-K7196, and a coefficient of friction of 0.2 or less which is measured in accordance with ASTM-D1894.

According to the sublimation thermal image transfer recording method of the present invention, thermal image transfer from the sublimation thermal image transfer recording medium to the image receiving sheet can be efficiently carried out by moving the sublimation thermal image transfer recording medium with a speed of 1/n (n>1) relative to the image receiving sheet with a speed of 1.

The thermal image transfer recording medium of the present invention can be applied to other recording methods using recording means except a thermal head. For instance, it is possible to apply the thermal image transfer recording medium of the present invention to a recording method using a heat plate or a laser beam, or to a recording method which employs Joule's heat generated in the substrate or other portions of the recording medium, that is, the so-called electrothermic non-impact printing method. The electrothermic non-impact printing method is widely known as described in a variety of references, for example, U.S. Pat. No. 4,103,066, and Japanese Laid-Open Patent Applications 57-14061, 57-11080 and 59-9096.

For achieving the electrothermic non-impact printing method using the thermal image transfer recording medium of the present invention, the following materials may be used for the substrate of the recording medium according to the present invention: materials which are modified so as to have an intermediate electric resistivity between the electric resistivities of an insulating material and an electroconductive material, for example, by dispersing particles of metals such as aluminum, copper, iron, tin, zinc, nickel, molybdenum and silver, and/or electro-conductive particles such as carbon black, in a relatively high heat-resistant resin such as polyester, polycarbonate, triacetyl cellulose, nylon, polyimide, or aromatic polyamide. Alternatively, the substrate may be prepared by depositing any of the above-mentioned electroconductive metal particles on a film made of the above-mentioned resins by vacuum deposition or sputtering.

In this case, it is preferable that the thickness of the substrate be in the range of approximately 2 to 15 μm when the thermal conductivity of the substrate for the generated Joule's heat is taken into consideration.

When laser beams are employed for image transfer, a material capable of absorbing laser beams and generate heat may be chosen for the substrate of the thermal image transfer recording medium. For this purpose, for example, an agent which absorbs light and converts the light into heat, such as carbon black, may be contained in a conventional thermal image transfer film. Alternatively, a light-absorbing and heat-generating layer may be laminated on the front and/or back surface of the substrate.

Other features of this invention will become apparent in the course of the following description of exemplary embodiments, which are given for illustration of the invention and are not intended to be limiting thereof.

EXAMPLE 1

[Formation of Heat-Resistant Layer]

A silicone resin was coated on one side of an aromatic polyamide film with a thickness of about 6 μm, serving as a substrate, so that a heat resistant layer with a thickness of about 1 μm was provided on one side of the substrate.

[Formation of Intermediate Adhesive Layer]

The following components were mixed to prepare a coating liquid for an intermediate adhesive layer:

| | Parts by Weight |
|---|---|
| Polyvinyl butyral resin "BX-1" (Trademark) made by Sekisui Chemical Co., Ltd. | 10 |
| Diisocyanate "Coronate L" (Trademark) made by Nippon Polyurethane Industry Co., Ltd. | 5 |
| Solvents: | |
| Toluene | 95 |
| Methyl ethyl ketone | 95 |

The above obtained intermediate adhesive layer coating liquid was coated on the substrate, opposite to the heat-resistant layer with respect to the substrate, by use of a wire bar and dried, so that an intermediate adhesive layer with a thickness of about 1 μm on a dry basis was provided on the substrate.

[Formation of Dye-Containing Layer]

(1) Preparation of Dye-Supply Layer Coating Liquids for Yellow, Magenta and Cyan Ink Layer Sections The following components were mixed, whereby dye-supply layer coating liquids for a yellow ink layer section, a magenta ink layer section, and a cyan ink layer section were prepared:

| | Parts by Weight |
|---|---|
| Polyvinyl butyral resin | 7 |
| Sublimable dyes | 25 |
| For yellow ink layer section: "Yellow VP" (Trademark) made by Mitsui Toatsu Dyes, Ltd. | |
| For magenta ink layer section: "Magenta VP" (Trademark) made by Mitsui Toatsu Dyes, Ltd. | |
| For cyan ink layer section: "Cyan VP" (Trademark) made by Mitsui Toatsu Dyes, Ltd. | |
| Solvent: | |
| Butyl alcohol | 133 |

(2) Preparation of dye-transfer-contribution layer coating liquids for yellow, magenta and cyan ink layer sections

| | Parts by Weight |
|---|---|
| Polyvinyl butyral resin | 10 |
| Diisocyanate "TDH703" (Trademark) made by Takeda Chemical Industries, Ltd. | 5 |
| Solvents: | |
| Ethyl alcohol | 95 |
| Butyl alcohol | 95 |

For the yellow ink layer section, magenta ink layer section and cyan ink layer section, the above-mentioned dye-supply layer coating liquid and dye-transfer-contribution layer coating liquid were successively coated on the intermediate adhesive layer by a wire bar, and dried, so that a dye-supply layer with a thickness of about 4.0 μm on a dry basis and a dye-transfer-contribution layer with a thickness of about 1.0 μm on a dry basis were successively overlaid on the intermediate adhesive layer with respect to each color section.

[Formation of Top Layer]

The following components were mixed to prepare a coating liquid for a top layer:

| | Parts by Weight |
|---|---|
| Resin solution No. A-1 prepared in Preparation Example 2 | 100 |
| Isopropyl alcohol | 100 |
| Acetylacetone aluminum | 0.3 |

The thus prepared top layer coating liquid was coated on the dye-transfer-contribution layer by a wire bar, and dried, so that a top layer with a thickness of 0.7 μm on a dry basis was provided on the dye-transfer-contribution layer.

Thus, a sublimation-type thermal image transfer recording medium No. 1 according to the present invention was obtained.

EXAMPLE 2

The procedure for the preparation of the sublimation-type thermal image transfer recording medium No. 1 in Example 1 was repeated except that the formulation for the top layer coating liquid employed in Example 1 was changed to the following formulation:

[Formulation for Top Layer Coating Liquid]

| | Parts by Weight |
|---|---|
| Resin Solution No. A-2 prepared in Preparation Example 3 | 100 |
| Isopropyl alcohol | 100 |
| Acetylacetone aluminum | 0.3 |

Thus, a sublimation-type thermal image transfer recording medium No. 2 according to the present invention was obtained.

EXAMPLE 3

The procedure for the preparation of the sublimation-type thermal image transfer recording medium No. 1 in Example 1 was repeated except that the formulation for the top layer coating liquid employed in Example 1 was changed to the following formulation:

[Formulation for Top Layer Coating Liquid]

| | Parts by Weight |
|---|---|
| Resin solution No. A-2 prepared in Preparation Example 3 | 100 |
| Cross-linking agent (silane compound) prepared in Preparation Example 1 | 15 |
| Isopropyl alcohol | 100 |
| Acetylacetone aluminum | 0.3 |

Thus, a sublimation-type thermal image transfer recording medium No. 3 according to the present invention was obtained.

EXAMPLE 4

The procedure for the preparation of the sublimation-type thermal image transfer recording medium No. 1 in Example 1 was repeated except that the formulation for the top layer coating liquid employed in Example 1 was changed to the following formulation:

[Formulation for Top Layer Coating Liquid]

| | Parts by Weight |
|---|---|
| Resin solution No. A-2 prepared in Preparation Example 3 | 100 |
| Cross-linking agent (silane compound) prepared in Preparation Example 1 | 15 |
| Isopropyl alcohol | 100 |
| Acetylacetone aluminum | 0.3 |
| Epoxy-modified silicone oil "SF8411" (Trademark) made by Dow Corning Toray Silicone Co., Ltd. | 3 |

Thus, a sublimation-type thermal image transfer recording medium No. 4 according to the present invention was obtained.

EXAMPLE 5

The procedure for the preparation of the sublimation-type thermal image transfer recording medium No. 1 in Example 1 was repeated except that the formulation for the top layer coating liquid employed in Example 1 was changed to the following formulation:

[Formulation for Top Layer Coating Liquid]

| | Parts by Weight |
|---|---|
| Resin solution No. A-2 prepared in Preparation Example 3 | 100 |
| Cross-linking agent (silane compound) prepared in Preparation Example 1 | 15 |
| Isopropyl alcohol | 100 |
| Acetylacetone aluminum | 0.3 |
| Epoxy-modified silicone oil "SF8411" (Trademark) made by Dow Corning Toray Silicone Co., Ltd. | 2 |
| Dimethyl silicone oil "SH200" (Trademark) made by Dow Corning Toray Silicone Co., Ltd. | 2 |

Thus, a sublimation-type thermal image transfer recording medium No. 5 according to the present invention was obtained.

EXAMPLE 6

The procedure for the preparation of the sublimation-type thermal image transfer recording medium No. 1 in Example 1 was repeated except that the formulation for the top layer coating liquid employed in Example 1 was changed to the following formulation:

[Formulation for Top Layer Coating Liquid]

| | Parts by Weight |
|---|---|
| Resin solution No. A-5 prepared in Preparation Example 6 | 100 |
| Cross-linking agent (silane compound) prepared in Preparation Example 1 | 15 |
| Isopropyl alcohol | 100 |
| Acetylacetone aluminum | 0.3 |

Thus, a sublimation-type thermal image transfer recording medium No. 6 according to the present invention was obtained.

EXAMPLE 7

The procedure for the preparation of the sublimation-type thermal image transfer recording medium No. 1 in Example 1 was repeated except that the formulation for the top layer coating liquid employed in Example 1 was changed to the following formulation:

[Formulation for Top Layer Coating Liquid]

| | Parts by Weight |
|---|---|
| Silicone graft polymer "DAIALLOMER SP712" (Trademark) made by DainichiSeika Color and Chemicals Mfg. Co., Ltd. | 30 |
| Isocyanate (adduct of tolylene diisocyanate with trimethylolpropane) "Takenate D103H" (Trademark) made by Takeda Chemical Industries, Ltd. | 3 |
| Methyl ethyl ketone | 70 |

Thus, a sublimation-type thermal image transfer recording medium No. 7 according to the present invention was obtained.

EXAMPLE 8

The procedure for the preparation of the sublimation-type thermal image transfer recording medium No. 1 in Example 1 was repeated except that the formulation for the top layer coating liquid employed in Example 1 was changed to the following formulation:

[Formulation for Top Layer Coating Liquid]

| | Parts by Weight |
|---|---|
| Silicone graft polymer "DAIALLOMER SP712" (Trademark) made by DainichiSeika Color and Chemicals Mfg. Co., Ltd. | 30 |
| Isocyanate (trimer of tolylene diisocyanate) "Takenate D218H" (Trademark) made by Takeda Chemical Industries, Ltd. | 3 |
| n-butanol | 70 |

Thus, a sublimation-type thermal image transfer recording medium No. 8 according to the present invention was obtained.

EXAMPLE 9

The procedure for the preparation of the sublimation-type thermal image transfer recording medium No. 1 in Example 1 was repeated except that the formulation for the top layer coating liquid employed in Example 1 was changed to the following formulation:

[Formulation for Top Layer Coating Liquid]

| | Parts by Weight |
|---|---|
| Silicone graft polymer "DAIALLOMER SP712" (Trademark) made by DainichiSeika Color and Chemicals Mfg. Co., Ltd. | 30 |
| Isocyanate (adduct of tolylene diisocyanate with trimethylolpropane) "Takenate D103H" (Trademark) made by Takeda Chemical Industries, Ltd. | 3 |
| Isopropyl alcohol | 70 |

Thus, a sublimation-type thermal image transfer recording medium No. 9 according to the present invention was obtained.

EXAMPLE 10

The procedure for the preparation of the sublimation-type thermal image transfer recording medium No. 1 in Example 1 was repeated except that the formulation for the top layer coating liquid employed in Example 1 was changed to the following formulation:

[Formulation for Top Layer Coating Liquid]

| | Parts by Weight |
|---|---|
| Silicone graft polymer "DAIALLOMER SP712" (Trademark) made by DainichiSeika Color and Chemicals Mfg. Co., Ltd. | 30 |
| Isocyanate (adduct of tolylene diisocyanate with trimethylolpropane) "Takenate D103H" (Trademark) made by Takeda Chemical Industries, Ltd. | 3 |
| 2-methyl-2-butanol | 70 |

Thus, a sublimation-type thermal image transfer recording medium No. 10 according to the present invention was obtained.

EXAMPLE 11

The procedure for the preparation of the sublimation-type thermal image transfer recording medium No. 1 in Example 1 was repeated except that the formulation for the top layer coating liquid employed in Example 1 was changed to the following formulation:

[Formulation for Top Layer Coating Liquid]

| | Parts by Weight |
|---|---|
| Silicone graft polymer "DAIALLOMER SP712" (Trademark) made by DainichiSeika Color and Chemicals Mfg. Co., Ltd. | 30 |
| Isocyanate (adduct of 1,3-bis(isocyanatomethyl) cyclohexane with trimethylolpropane) "Takenate D120N" (Trademark) made by Takeda Chemical Industries, Ltd. | 3 |
| n-butanol | 70 |

Thus, a sublimation-type thermal image transfer recording medium No. 11 according to the present invention was obtained.

EXAMPLE 12

The procedure for the preparation of the sublimation-type thermal image transfer recording medium No. 1 in Example 1 was repeated except that the formulation for the top layer coating liquid employed in Example 1 was changed to the following formulation:

[Formulation for Top Layer Coating Liquid]

| | Parts by Weight |
|---|---|
| Silicone graft polymer "DAIALLOMER SP712" (Trademark) made by DainichiSeika Color and Chemicals Mfg. Co., Ltd. | 30 |
| Isocyanate (hydrophilic aliphatic isocyanate) "STAPHYLOID THD703" (Trademark) made by Takeda Chemical Industries, Ltd. | 3 |
| 2-methyl-2-butanol | 70 |

Thus, a sublimation-type thermal image transfer recording medium No. 12 according to the present invention was obtained.

COMPARATIVE EXAMPLE 1

The procedure for the preparation of the sublimation-type thermal image transfer recording medium No. 1 in Example 1 was repeated except that the formulation for the top layer coating liquid employed in Example 1 was changed to the following formulation:

[Formulation for Top Layer Coating Liquid]

| | Parts by Weight |
|---|---|
| Styrene-maleic acid copolymer "AP30" (Trademark) made by BASF Japan Ltd. | 10 |
| Alcohol-modified silicone oil "SF8427" (Trademark) made by Toray Industries, Inc. | 1 |
| Solvent: | |
| Ethanol | 50 |

Thus, a comparative sublimation-type thermal image transfer recording medium No. 1 was obtained.

COMPARATIVE EXAMPLE 2

The procedure for the preparation of the sublimation-type thermal image transfer recording medium No. 1 in Example 1 was repeated except that the formulation for the top layer coating liquid employed in Example 1 was changed to the following formulation:

[Formulation for Top Layer Coating Liquid]

| | Parts by Weight |
|---|---|
| Styrene-maleic acid copolymer "AP30" (Trademark) made by BASF Japan Ltd. | 5 |
| Liquid A (*) | 10 |
| Alcohol-modified silicone oil "SF8427" (Trademark) made by Toray Industries, Inc. | 1 |
| Solvent: | |
| Ethanol | 25 |

In the above-mentioned formulation for the top layer coating liquid, the liquid A (*) was prepared by dissolving 15 g of dimethyl methoxysilane and 9 g of methyl trimethoxysilane in a mixed solvent consisting of 12 g of toluene and 12 g of methyl ethyl ketone, and subjecting the above obtained solution to hydrolysis for 3 hours, with the addition thereto of 13 me of 3% sulfuric acid.

Thus, a comparative sublimation-type thermal image transfer recording medium No. 2 was obtained.

COMPARATIVE EXAMPLE 3

The procedure for the preparation of the sublimation-type thermal image transfer recording medium No. 1 in Example 1 was repeated except that the formulation for the top layer coating liquid employed in Example 1 was changed to the following formulation:

[Formulation for Top Layer Coating Liquid]

| | Parts by Weight |
|---|---|
| Polyvinyl butyral resin | 10 |
| Diisocyanate "TDH703" (Trademark) made by Takeda Chemical Industries, Ltd. | 5 |
| Alcohol-modified silicone oil "SF8427" (Trademark) made by Toray Co., Ltd. | 1 |
| Solvent: | |
| Ethyl alcohol | 80 |

Thus, a comparative sublimation-type thermal image transfer recording medium No. 3 was obtained.

COMPARATIVE EXAMPLE 4

The procedure for the preparation of the sublimation-type thermal image transfer recording medium No. 1 in Example 1 was repeated except that the formulation for the top layer coating liquid employed in Example 1 was changed to the following formulation:

[Formulation for Top Layer Coating Liquid]

| | Parts by Weight |
|---|---|
| Silicone graft polymer "DAIALLOMER SP712" (Trademark) made by DainichiSeika Color and Chemicals Mfg. Co., Ltd. | 30 |
| Methyl ethyl ketone | 70 |

Thus, a comparative sublimation-type thermal image transfer recording medium No. 4 was obtained.

With respect to each of the above obtained sublimation-type thermal image transfer recording media No. 1 to No. 12 according to the present invention and comparative thermal image transfer recording media No. 1 to No. 4, the physical properties of the top layer were measured in terms of the softening point, the coefficient of friction, the dyeability, and the pot life of a coating liquid in the following manners:

1) Softening Point

Each coating liquid for the top layer employed in Examples 1 to 12 and Comparative Examples 1 to 4 was applied to a 6-$\mu$m-thick aromatic polyamide film, so that a sample layer with a thickness of about 5 $\mu$m was formed on the film.

Using a commercially available measuring instrument "TMA 2940" (Trademark), made by TA Instruments Co., Ltd., the softening point of the sample layer was measured in accordance with Japanese Industrial Standards JIS-K7196 under the conditions that the diameter of a needle was 1 mm and the applied load was 0.49N.

(2) Coefficient of Friction

Using a commercially available surface property tester "HEIDON-14S" (Trademark), made by Shinto Scientific Co., Ltd., the coefficient friction of the top layer provided on the surface of each sublimation-type thermal image transfer recording medium was measured in accordance with ASTM-D1894 in such a manner that an aromatic polyamide film was brought into contact with the top layer.

(3) Dyeability

Each coating liquid for the top layer employed in Examples 1 to 12 and Comparative Examples 1 to 4 was applied to a 150-$\mu$m-thick sheet of synthetic paper, so that a sample image-receiving layer with a thickness of about 5 $\mu$m was formed on the synthetic paper.

Each sample image-receiving layer provided on the synthetic paper was superimposed on a commercially available thermal image transfer medium (thermal transfer recording sheet for color video copy processor, made by Mitsubishi Electric Corporation). Using a printing test apparatus, a test pattern image was transferred from the thermal transfer recording sheet to the sample image-receiving layer by the application of heat through a thermal head under such conditions that the resolution was 6 dots/mm and the applied energy was 2.0 mJ/dot. The density of the thus obtained test pattern image was measured using a Mcbeth densitometer RD-918.

(3) Pot Life of Coating Liquid

After preparation of the composition of the top layer coating liquid, a small amount of the coating liquid was taken as a sample at regular intervals. The sample coating liquid for the top layer was applied to a 6-μm-thick aromatic polyamide film, so that a sample layer with a thickness of about 5 μm was formed on the film. Thus, a sample sheet was obtained. The weight of the sample sheet was measured. Then, the sample sheet was immersed into a solvent. After taken from the solvent, the weight of the sample sheet was measured again. The pot life of the top layer coating liquid was expressed by the period of time until the weight of the sample sheet was first reduced by dissolving the sample sheet in the solvent.

The results of the above-mentioned physical properties of the top layer for use in each thermal image transfer recording medium are shown in Table 1.

In order to evaluate the performance of the sublimation-type thermal image transfer recording media No. 1 to No. 12 according to the present invention and comparative thermal image transfer recording media No. 1 to No. 4, an image receiving sheet was prepared in accordance with the following method:

[Preparation of Image Receiving Sheet]

An intermediate layer coating liquid with the following formulation was coated on a commercially available synthetic paper with a thickness of about 150 μm "Yupo FP-150" (Trademark), made by Oji-Yuka Synthetic Paper Co., Ltd., serving as a support, and dried at 75° C. for one minute, so that an intermediate layer was formed on the support.

(Formulation for Intermediate Layer Coating Liquid)

| | Parts by Weight |
|---|---|
| Vinyl chloride-vinyl acetate-vinyl alcohol copolymer "VAGH" (Trademark) made by Union Carbide Japan K.K. | 10 |
| Diisocyanate "Coronate L" (Trademark) made by Nippon Polyurethane Industry Co., Ltd. | 5 |
| Solvents: | |
| Toluene | 40 |
| Methyl ethyl ketone | 40 |

An image receiving layer coating liquid with the following formulation was then coated on the above provided intermediate layer, and dried at 75° C. for one minute, so that an image receiving layer was provided on the intermediate layer.

(Formulation for Image Receiving Layer Coating Liquid)

| | Parts by Weight |
|---|---|
| Vinyl chloride-vinyl acetate-vinyl alcohol copolymer | 10 |
| Diisocyante | 5 |
| Dimethyl silicone oil "SH200" (Trademark) made by Dow Corning Toray Silicone Co., Ltd. | 0.5 |
| Epoxy-modified silicone oil "SF8411" (Trademark) made by Dow Corning Toray Silicone Co., Ltd. | 0.5 |
| Solvents: | |
| Toluene | 40 |
| Methyl ethyl ketone | 40 |

The above obtained laminated material was allowed to stand at 60° C. for 24 hours for curing the coated layers, whereby an image receiving sheet was prepared.

Using the above obtained image receiving sheet and each sublimation thermal image transfer recording medium, various tests were carried out to evaluate the following performance:

[1] Prevention of Fusing and Sticking of the Thermal Image Transfer Recording Medium to the Image Receiving Sheet Images were transferred from each of the sublimation-type thermal image transfer recording media to the image receiving sheet in the following four recording modes by changing the transporting speed of the image receiving sheet relative to that of the thermal image transfer recording medium, with heat being applied thereto through a thermal head under the conditions that the resolution of the thermal head was 12 dots/mm, the applied energy was 0.64 mJ/dot, and the applied electric power was 0.16 W/dot.

| | |
|---|---|
| [3-times-speed mode] | |
| Transporting speed of image receiving sheet: | 8.4 mm/sec |
| Transporting speed of thermal image transfer recording medium: | 2.8 mm/sec |
| [7-times-speed mode] | |
| Transporting speed of image receiving sheet: | 8.4 mm/sec |
| Transporting speed of thermal image transfer recording medium: | 1.2 mm/sec |
| [10-times-speed mode] | |
| Transporting speed of image receiving sheet: | 8.4 mm/sec |
| Transporting speed of thermal image transfer recording medium: | 0.84 mm/sec |
| [15-times-speed mode] | |
| Transporting speed of image receiving sheet: | 8.4 mm/sec |
| Transporting speed of thermal image transfer recording medium: | 0.56 mm/sec |

The condition of the adhesion of the thermal image transfer recording medium to the image receiving sheet was visually evaluated in accordance with the following scale:

○: Thermal image transfer was normally performed.

Δ: A fused small portion of the thermal image transfer recording medium stuck to the image receiving sheet.

x: The adhesion and sticking of the thermal image recording medium to the image receiving sheet was considerable.

The results are shown in Table 1.

[2] Prevention of Image Blurring

A solid magenta ink image of a square form was transferred to the image receiving sheet, and then a solid cyan ink image of a larger square form was transferred to the image receiving sheet by the n-times-speed mode (n=3) in such a fashion that the magenta square image was entirely covered with the cyan square image. The blurring of the magenta square image caused by re-transferring of the magenta ink once transferred to the image receiving sheet to the thermal image transfer recording medium was visually observed, and evaluated in accordance with the following scale:

○: Thermal image transfer was normally performed with no blurring of the magenta image.

Δ: The blurring of the magenta image was slightly observed.

x: The blurring of the magenta image was considerable.

The results are shown in Table 1.

Δ: The solid ink image was slightly lacking in uniformity.

x: The solid ink image was considerably lacking in uniformity.

The results are shown in Table 1.

TABLE 1

| | Softening Point of Top Layer | Coefficient of Friction | Dyeability(*) | Pot Life of Top Layer Coating Liquid | Sticking Prevention Performance n = 3 | n = 7 | n = 10 | n = 15 | Image Blurring Prevention Performance | Thermal Sensitivity | Preservability in the Dark | Uniformity of Ink Image |
|---|---|---|---|---|---|---|---|---|---|---|---|---|
| Ex. 1 | 256 | 0.15 | 0.75 | 8 hours or more | ○ | ○ | Δ | X | ○ | 2.10 | ○ | ○ |
| Ex. 2 | 274 | 0.17 | 0.82 | 8 hours or more | ○ | ○ | Δ | Δ | ○ | 2.15 | ○ | ○ |
| Ex. 3 | 268 | 0.14 | 0.72 | 8 hours or more | ○ | ○ | ○ | Δ | ○ | 2.03 | ○ | ○ |
| Ex. 4 | 302 | 0.11 | 0.70 | 8 hours or more | ○ | ○ | ○ | ○ | ○ | 2.06 | ○ | Δ |
| Ex. 5 | 305 | 0.11 | 0.69 | 8 hours or more | ○ | ○ | ○ | ○ | ○ | 2.04 | ○ | Δ |
| Ex. 6 | 303 | 0.12 | 0.73 | 8 hours or more | ○ | ○ | ○ | ○ | ○ | 2.10 | ○ | ○ |
| Ex. 7 | 320 | 0.11 | 1.43 | 8 hours or more | ○ | ○ | ○ | ○ | Δ | 2.12 | Δ | ○ |
| Ex. 8 | 320 | 0.11 | 1.45 | 1 hour | ○ | ○ | ○ | ○ | Δ | 2.10 | ○ | ○ |
| Ex. 9 | 320 | 0.11 | 1.41 | 3 hours | ○ | ○ | ○ | ○ | Δ | 2.21 | ○ | ○ |
| Ex. 10 | 320 | 0.10 | 1.35 | 4 hours | ○ | ○ | ○ | ○ | Δ | 2.00 | ○ | ○ |
| Ex. 11 | 320 | 0.13 | 1.40 | 4 hours | ○ | ○ | ○ | ○ | Δ | 2.10 | ○ | ○ |
| Ex. 12 | 320 | 0.12 | 1.36 | 6 hours | ○ | ○ | ○ | ○ | Δ | 2.02 | ○ | ○ |
| Comp. Ex. 1 | 112 | 0.25 | 1.05 | 8 hours or more | X | X | X | X | Δ | — | ○ | Δ |
| Comp. Ex. 2 | 110 | 0.35 | 0.95 | 8 hours or more | ○ | ○ | Δ | X | ○ | 1.88 | Δ | Δ |
| Comp. Ex. 3 | 307 | 0.21 | 1.42 | 5 hours | ○ | ○ | Δ | Δ | X | 1.62 | X | Δ |
| Comp. Ex. 4 | 107 | 0.19 | 0.85 | 8 hours or more | ○ | Δ | X | X | Δ | 2.20 | ○ | ○ |

(*)The dyeability of the dye image receiving layer of the image receiving sheet subjected to the evaluation was 1.40.

[3] Thermal Sensitivity

A test pattern image was transferred from each thermal image transfer recording medium to the image receiving sheet under the application of the same thermal energy to each recording medium. The density of the obtained ink image was measured using a Mcbeth densitometer.

[4] Preservability of Recording Medium in the Dark

Each thermal image transfer recording medium was stored at 60° C. and 50% RH in the dark for 100 hours. 100 hours later, ink images were transferred from the thermal image transfer recording medium to the ink receiving sheet. It was visually observed whether the background, that is, a non-printed portion of the ink receiving sheet was stained with the ink, or not, and evaluated in accordance with the following scale:

○: There was no ink deposition on the background of the image receiving sheet.

Δ: Ink deposition was slightly observed on the background of the image receiving sheet.

x: Ink deposition on the background of the image receiving sheet was considerable.

The results are shown in Table 1.

[5] Uniformity of Obtained Ink Image

The uniformity of a solid ink image transferred to the image receiving sheet from each thermal image transfer recording medium was visually inspected, and evaluated in accordance with the following scale:

○: The solid ink image was very uniform.

As previously explained, since the softening point of the top layer for use in the sublimation thermal image transfer recording medium of the present invention is 200 ° C. or more when measured in accordance with JIS K-7196, and the coefficient of friction of the top layer is 0.2 or less when measured in accordance with ASTM-D1894, the lubricity, releasability and heat resistance of the thermal image transfer recording medium are superior to conventional ones. As a result, the sticking problem can be solved.

When the dyeability of the top layer of the above-mentioned thermal image transfer recording medium is controlled to be lower than that of the dye image receiving layer of the image receiving sheet, the image blurring and a ghost image, which result from the re-transferring of the ink image once transferred to the image receiving sheet to the recording medium, can be prevented when color images are superimposed by the n-times-speed mode.

In the sublimation thermal image transfer recording medium, it is preferable that the top layer comprises a block copolymer (A) which comprises a polydimethyl siloxane moiety and a vinyl polymer moiety including a hydrolyzable silyl group and is cured. In this case, when the block copolymer (A) is cured, using a cross-linking agent (B) such as an alkoxysilane compound, chlorosilane compound, a monomer or polymer of a silane coupling agent, or a hydrolysis product of a compound having a hydrolyzable group; or using at least one catalyst such as an aluminum chelating agent, an organic tin compound, an organic titanate compound, an organic acid or an inorganic acid, the sticking preventing effect is further improved. In addition, re-transferring of the dye to the top layer of the thermal image transfer recording medium from the image receiving sheet can be minimized although the permeability of the dye through the top layer is excellent. Therefore, both of the increase of thermal sensitivity of the recording medium and the prevention of the image blurring can be accomplished at the same time.

Further, when the top layer of the thermal image transfer recording medium of the present invention further comprises a silicone oil, the lubricity of the recording medium can be improved, so that the value of "n" in the n-times-speed mode can be increased in the thermal image transfer recording operation.

When the block copolymer (A) for use in the top layer comprises at least two polydimethyl siloxane moieties with different weight average molecular weights within the range of 1,000 to 30,000, the value of "n" in the n-times-speed mode can be increased in the thermal image transfer recording operation. In this case, it is not necessary to add a silicone oil to the top layer, so that the side effect caused by the addition of the silicone oil to the top layer, that is, lack of uniformity in the obtained image can be avoided.

When the top layer of the thermal image transfer recording medium of the present invention comprises a silicone graft polymer, which is cured using an isocyanate compound, the lubricity of the recording medium can be improved, so that the value of "n" in the n-times-speed mode can be increased in the thermal image transfer recording operation.

In the above-mentioned embodiment, it is preferable to employ an alicyclic or aliphatic isocyanate compound, or a hydrophilic isocyanate compound. When such a top layer is provided on the dye-containing layer by a coating method using an alcohol solvent, such as a secondary alcohol or a tertiary alcohol, it is possible to provide a cured top layer with high heat resistance without dissolving the sublimable dye for use in the dye-containing layer in the above-mentioned solvent during the preparation of the top layer.

Japanese Patent Application No. 7-335745 filed Nov. 30, 1995; and Japanese Patent Application filed Nov. 22, 1996 are hereby incorporated by reference.

What is claimed is:

1. A sublimation thermal image transfer recording medium comprising:

a substrate;

a dye-containing layer formed on said substrate, comprising a sublimable dye; and a top layer formed on said dye-containing layer, having a softening temperature of at least 200° C. which is measured in accordance with Japanese Industrial Standards JIS-K7196, and a coefficient of friction of 0.2 or less which is measured in accordance with ASTM-D1894.

2. The sublimation thermal image transfer recording medium as claimed in claim 1, wherein said top layer comprises a block copolymer which comprises a polydimethyl siloxane moiety and a vinyl polymer moiety including a hydrolyzable silyl group and is cured.

3. The sublimation thermal image transfer recording medium as claimed in claim 2, wherein said block copolymer is cured, using a cross-linking agent selected from the group consisting of an alkoxysilane, a chlorosilane, a monomer or polymer of a silane coupling agent, and a hydrolysis product of a compound having a hydrolyzable group.

4. The sublimation thermal image transfer recording medium as claimed in claim 2, wherein said block copolymer is cured, using at least one catalyst selected from the group consisting of an aluminum chelating agent, an organic tin compound, an organic titanate compound, an organic acid, and an inorganic acid.

5. The sublimation thermal image transfer recording medium as claimed in claim 2, wherein said polydimethyl siloxane moiety comprises at least two polydimethyl siloxane moieties with different weight average molecular weights.

6. The sublimation thermal image transfer recording medium as claimed in claim 5, wherein said different weight average molecular weights are in the range of 1,000 to 30,000.

7. The sublimation thermal image transfer recording medium as claimed in claim 2, wherein said top layer further comprises a silicone oil in an effective amount for reducing the coefficient of friction of said top layer.

8. The sublimation thermal image transfer recording medium as claimed in claim 2, wherein said top layer is provided on said dye-containing layer by a coating method using an alcohol solvent.

9. The sublimation thermal image transfer recording medium as claimed in claim 1, wherein said top layer comprises a silicone graft polymer.

10. The sublimation thermal image transfer recording medium as claimed in claim 9, wherein said top layer is provided on said dye-containing layer by a coating method using an alcohol solvent.

11. The sublimation thermal image transfer recording medium as claimed in claim 9, wherein said silicone graft polymer in said top layer is cured, using an isocyanate compound.

12. The sublimation thermal image transfer recording medium as claimed in claim 11, wherein said isocyanate compound is selected from the group consisting of an alicyclic isocyanate compound and an aliphatic isocyanate compound.

13. The sublimation thermal image transfer recording medium as claimed in claim 11, wherein said isocyanate compound is a hydrophilic isocyanate compound.

14. The sublimation thermal image transfer recording medium as claimed in claim 11, wherein said top layer is provided on said dye-containing layer by a coating method using an alcohol solvent selected from the group consisting of a secondary alcohol and a tertiary alcohol.

15. A sublimation thermal image transfer recording method for performing thermal image transfer comprising the step of superimposing an image receiving sheet on a sublimation thermal image transfer recording medium, with imagewise application of heat thereto, thereby performing thermal image transfer from said sublimation thermal image transfer recording medium to said image receiving sheet, said image receiving sheet comprising a dye image receiving layer which receives sublimable dye images, and said sublimation thermal image transfer recording medium comprising a substrate, a dye-containing layer formed on said substrate, comprising a sublimable dye, and a top layer formed on said dye-containing layer, having a softening temperature of at least 200° C. which is measured in accordance with Japanese Industrial Standards JIS-K7196, and a coefficient of friction of 0.2 or less which is measured in accordance with ASTM-D1894, the dyeability of said top layer of said sublimation thermal image transfer recording medium being lower than the dyeability of said dye image receiving layer of said image receiving sheet.

16. The sublimation thermal image transfer recording method as claimed in claim 15, wherein said thermal image transfer from said sublimation thermal image transfer recording medium to said image receiving sheet is carried out by moving said sublimation thermal image transfer recording medium with a speed of 1/n (n>1) relative to said image receiving sheet with a speed of 1.

* * * * *

UNITED STATES PATENT AND TRADEMARK OFFICE

CERTIFICATE OF CORRECTION

PATENT NO. : 5,834,396

DATED : November 10, 1998

INVENTOR(S) : Hiroyuki UEMURA et al

It is certified that error appears in the above-identified patent and that said Letters Patent is hereby corrected as shown below:

Column 4, line 23, "constantly." should read --constant.--.

Column 8, line 2, "a-methylstyrene" should read --α-methylstyrene--.

Column 15, line 14, "generate" should read --generating--.

Column 21, line 42, "13 me" should read --13 mℓ--.

Column 23, line 5, "immersed into" should read --immersed in--.

Column 27, line 8, "both of the" should read --both the--.

Signed and Sealed this

Twenty-eighth Day of November, 2000

*Attest:*

Q. TODD DICKINSON

*Attesting Officer*

*Director of Patents and Trademarks*